US006983558B2

(12) United States Patent
Haas

(10) Patent No.: US 6,983,558 B2
(45) Date of Patent: Jan. 10, 2006

(54) INEXPENSIVE SNOWPLOW

(76) Inventor: Theodore Otto Haas, 46 Meadows La., Haverford, PA (US) 19041

( * ) Notice: Subject to any disclaimer, the term of this patent is extended or adjusted under 35 U.S.C. 154(b) by 53 days.

(21) Appl. No.: 10/851,937

(22) Filed: May 21, 2004

(65) Prior Publication Data

US 2004/0211095 A1 Oct. 28, 2004

Related U.S. Application Data

(63) Continuation-in-part of application No. 10/230,446, filed on Aug. 30, 2002, now abandoned.

(51) Int. Cl.
*E01H 5/06* (2006.01)

(52) U.S. Cl. ..... 37/269; 37/273

(58) Field of Classification Search ..... 37/266, 37/267, 269, 268, 272, 273, 278
See application file for complete search history.

(56) References Cited

U.S. PATENT DOCUMENTS

| | | | | |
|---|---|---|---|---|
| 79,913 | A | 7/1868 | Lewis | |
| 146,333 | A * | 1/1874 | Gray | 37/269 |
| 194,386 | A * | 8/1877 | Thatcher | 37/269 |
| 235,201 | A | 12/1880 | Bond | |
| 1,393,724 | A | 10/1921 | Lackie | |
| 1,480,504 | A * | 1/1924 | Clark | 172/663 |
| 1,811,436 | A | 6/1931 | Luyster | |
| 3,800,447 | A | 4/1974 | Harvery | |
| 4,403,432 | A | 9/1983 | Biance | |
| 4,680,880 | A | 7/1987 | Boneta | |
| 4,796,367 | A * | 1/1989 | Kulat | 37/273 |
| 4,907,357 | A | 3/1990 | Lilienthal | |
| 5,595,007 | A | 1/1997 | Biance | |
| 5,930,922 | A | 8/1999 | Altheide | |
| 6,070,343 | A | 6/2000 | Sheldon | |
| 6,151,809 | A | 11/2000 | Altheide | |

OTHER PUBLICATIONS

Consumer Reports magazine, Oct. 1997, p. 28 "Alternatives to the snow shovel".

* cited by examiner

*Primary Examiner*—Meredith Petravick

(57) ABSTRACT

A lightweight, adjustable snowplow, able to be lifted, carried, and manipulated by one person (adult or teenager) of normal strength, designed to remove new-fallen or otherwise soft snow or slush. It has a minimum number of parts. A plurality of struts attaches the plow to any kind of towing vehicle, providing horizontal stability. No brackets, hitches, or lifting devices are needed on the towing vehicle.

6 Claims, 2 Drawing Sheets

INEXPENSIVE SNOWPLOW

CROSS REFERENCE TO RELATED APPLICATIONS

This application is a Continuation-in-Part of application Ser. No. 10/230,446, filed Aug. 30, 2002 (published on Mar. 4, 2004 as Application 20040040184) by the present inventor, now abandoned. Disclosure Document 511438 covering this invention was mailed on May 6, 2002 and acknowledged by the PTO on May 13, 2002.

BACKGROUND OF THE INVENTION a. Field of the Invention

The invention relates to devices for removing snow from driveways; from streets, roads, highways, etc. (hereinafter for simplicity called "roadways"); from all or parts of parking lots; and from sidewalks and other walkways.

b. Description of the Prior Art

Most plows for the removal of snow are mounted on the front of a vehicle. However, snowplows made for attachment to the front of vehicles are very heavy and require much bracket hardware and other complex hardware for controlling and stabilizing purposes. Their weight and rigidity often cause damage to roadway surfaces, curbs, and imbedded reflectors in fog-prone areas. Such snowplows are also very expensive, bulky, and heavy—too much so for the individual householder, the small-business person, the entrepreneur offering light-duty snow removal service, or a teenager seeking after-school or weekend jobs. Such snowplows are difficult to assemble, difficult to attach to vehicles, and, when not needed out of season, difficult to detach and to store. Further, such snowplows are not suited for attaching to ordinary automobiles or other relatively lightweight vehicles, requiring instead some kind of heavy-duty truck.

Modern vehicles are able to travel without difficulty over new-fallen snow, otherwise still-soft snow, or slush several inches deep, even without such enhancing equipment as all-weather tires, four-wheel drive, limited-slip differential, etc. Therefore, if a vehicle can drive over a snow-laden path, a towed snowplow is practicable.

A number of snowplows have been designed for attaching to the rear of vehicles or other means of propulsion. However, they suffer many limitations and disadvantages.

Two of these devices, for example, under U.S. Pat. Nos. 3,800,447 to Harvey and 4,907,357 to Lilienthal are designed not for general removal of snow from a path, but merely to remove snow from a close to a wall or garage door where the vehicle's front-mounted plow cannot each.

In another example, a grading device under U.S. Pat. No. 6,070,343, to Sheldon, intended for grading or snow removal, is to be attached to a towing hitch. Most vehicles are not equipped with or suited for towing hitches. Further, among other disadvantages, the device has no provision for stability in relation to the rear of the vehicle. Differential resistance of snow or some small object encountered on the left side of the device, looking forward, would cause the chain on the right side to collapse and destroy the plow's ability to properly deposit the snow.

Still other devices, such as those under U.S. Pat. Nos. 4,403,432 and 5,595,007 to Biance, and U.S. Pat. Nos. 5,930,922 and 6,151,809 to Altheide require much hardware to control the lifting and aiming of their devices. Such devices are very heavy, probably requiring handling by more than one person, they are time consuming to assemble and disassemble and to attach to and detach from a vehicle. They incur great expense, and they require a large space for storage.

Some snow clearing devices designed to be drawn purport to be snowplows, but are really devices that could be better defined as "scoops" or "gatherers." For example, see U.S. Pat. No. 79,913 to Lewis, a vee-shaped device intended to clear snow from skating ponds and ice-lakes. Snow is repeatedly gathered inside the vee of the device and hauled to the side of the pond or lake and dumped. Another example occurs in U.S. Pat. No. 235,201 to Bond, whose snow scraping device also is intended to gather snow inside the vee of the device and remove it "from the surface of ice ponds and rivers where ice is to be cut and gathered."

Features that permit a snowplow to be lifted, manipulated, and carried by one person—light weight, compactness, and handhold devices—are of great importance in a light-duty vehicle-drawn snowplow. Several snowplow devices are purported to have parts that are of lightweight material, but their entire assemblage is not light in weight; for example, see U.S. Pat. No. 4,680,880 to Boneta (which happens to be for a front-loaded device), whose device is composed of many parts, most of them of heavy steel. In some cases, even if the device has some lightweight elements, the entire assemblage is both heavy and composed of multiple units impossible to lift and handle together; for example, see U.S. Pat. No. 1,393,724 to Lackie).

The blades of some snowplows have been fitted with replaceable wear strips, designed to prolong the life of the blades used for heavy-duty service. Examples are the snowplow under U.S. Pat. No. 1,811,436 to Luyster, which has steel wear strips fitted to wooden blades, and the moldboard for a snowplow under U.S. Pat. No. 3,477,149 to Wagner, which has very hard polyurethane rubber, on the order of 85 Durometer (that is, somewhere between the hardness of shoe heels and bowling balls). While these very hard, inflexible wear strips may serve their purpose to prolong blade life, they fail to address the problem of providing a cleaner removal of snow from surfaces that are uneven.

The methods used to vary the widths of various vee-shaped snowplows that have been patented are more cumbersome and time-consuming than necessary. For example, U.S. Pat. No. 509,811 to Jones discloses a hand-pushed snowplow whose width is varied by attaching a crossbar at varying points on both blades of the plow, a procedure that can be improved upon. In another example, under U.S. Pat. No. 1,811,436 to Luyster, varying the width of the snowplow is accomplished by using an adjustable crossbar consisting of a pipe within a pipe set at different lengths by use of a pin through holes in the pipes. It is not made clear how the pin is made secure, but it probably calls for some manipulation. This method is also one that can be improved upon.

A vee-shaped snowplow that is intended to be disassembled for storage or transportation needs a simple, uncomplicated, and inexpensive means of attaching and detaching its blades to and from each other at the vee point. An example of a vee-point that does not meet these criteria is shown in U.S. Pat. No. 509,811 to Jones, which calls for the manufacture and assembling of a completely separate vee-point unit, consisting of several parts. Another example of a device that fails to meet these criteria is shown in U.S. Pat. No. 1,811,436 to Luyster, which also calls for the manufacture and assembling of a complex multiplicity of parts. Still another example of a device that fails to meet these criteria is shown in U.S. Pat. No. 1,393,724 to Lackie, whose hinge is undoubtedly of the conventional kind having two plates with several knuckles, which requires two hands to exactly line up and hold the knuckles in place, and requires a third hand to insert a pin through the knuckles.

What is needed and not provided in the prior art is an effective snowplow with a minimum number of parts; that does not require attaching to a trailer hitch or other special hardware on the towing vehicle; that is simple and inexpensive to manufacture and sell; that is compact for shipping, transporting, and storing; that is lightweight and compact enough to be handled by one person, adult or teenager; that can be easily and quickly assembled and disassembled by one person; that can be easily and quickly attached to and detached from a vehicle; that does not require cumbersome and unsightly hardware on the towing vehicle; that is simple and efficient to operate; that is stable in use; that is as easily adjustable in width as possible; that can easily be adjusted to deposit snow on either or both sides of the path being plowed; that has provision for cleaning uneven surfaces; that requires very little propulsive power; that can overcome unusual or unexpected minor obstructions in the path being plowed; that is durable; and that will rarely, if ever, need repair.

The present invention addresses all of the limitations and problems found in the prior art, and it is designed to fulfill all of the criteria listed in the preceding paragraph.

SUMMARY OF THE INVENTION

The present invention is a device for the removal of new-fallen snow, otherwise still-soft snow, or slush from driveways, roadways, all or parts of parking lots, and from sidewalks and other walkways. (Since the object of plowing is to remove snow as soon as possible, virtually all snow to be removed is new-fallen or, at least, still soft.) This invention has a minimum number of parts, is effective, simple, inexpensive, lightweight, easily and quickly assembled and disassembled, easily and quickly attached to and detached from any kind of vehicle (with no cumbersome or unsightly hardware on the vehicle), compact, quickly and easily adjustable in width, quickly and easily adjustable in the direction of snow deposit (right or left side), operable with very little propulsive power, and not defeated by minor obstructions in the path being plowed.

Shortly after or during a snowstorm, people begin to remove snow with a shovel or a powered snow thrower, or engage vehicles with conventional plows to remove snow from driveways, roadways, parking lots, and walkways.

Shoveling snow is burdensome, time-consuming, and often dangerous to health and even life.

As far as snow throwers are concerned, *Consumer Reports* magazine (October 1997, page 28) pointed out that "Though faster and less physically taxing than shoveling snow, using a snow thrower isn't effortless or without its annoyances. It demands some awkward maneuvering of a heavy machine. And a snow thrower is costly. Expect to pay $300 to well over $1000, along with the ongoing costs of fuel, oil, and servicing. You'll also need a sizable space in which to store it." Further, snow throwers are not without their dangers; hospitals have reported quite a few cases each winter of fingers lost to snow throwers.

Vehicles engaged to remove snow are heavyweight vehicles with heavy plows attached, they are expensive to hire, they often cause damage to surfaces being plowed, they require much fuel for their operation, and consequently they cause much pollution of the air.

An object of the present invention is to contribute to conservation of the environment by providing a plow that (1) uses a minimum of material, (2) is lightweight, (3) requires very little propulsive power, (4) can be pulled by any motorized vehicle, (5) uses very little fuel for vehicle operation, and (6) causes a minimum of air pollution.

Another object of the present invention is to provide an effective, yet inexpensive way for users to remove large quantities of snow quickly, with very little physical effort, and with virtually no expense. Even if it were desirable to hire the removal of snow, engaging someone using a plow of the present design (possibly a teenager with a license to drive) would undoubtedly cost less than engaging someone using a conventional heavy-duty plow.

Another object of the present invention is saving the health and lives of many people each winter. Shoveling snow causes back strain in some people and heart strain in others. Still others suffer injuries from falling. Each year hospitals treat people who have had fingers cut off by snow throwers, as mentioned above. In spite of warnings, each winter many people attempt to clear snow from driveways and they die from the attempt, reportedly not only from the physical effort to push and lift snow, but also from breathing problems in the harsh weather conditions.

Another object of the present invention is to reduce the amount of time the user needs for clearing snow, and to reduce the user's time of exposure to the elements.

Another object of the present invention is to provide a means of removal of snow without resort to the use of salt, calcium chloride, or other substances that can be detrimental to the environment and harmful to automobile bodies.

Still another object of the invention is to provide a safe, cleared path for walking between the house and the front of the property for, say, reaching a curbside mailbox, moving trash for curbside pickup, or any pedestrian or bicycling purpose.

The present invention, after a minute or less to attach the lightweight plow to a vehicle, can clear great quantities of snow in a matter of seconds, without physical effort or breathing problems in cold and often windy conditions. The residence-size plow is light enough, under thirty pounds (less than fifteen pounds for each blade unit), that it can be easily handled by one adult or teenager. The larger sized plow of this invention, designed to clear even wider paths, is still light enough that it can handled by one adult of average strength. A small version of the plow is designed to clear long sidewalks and other walks, and it can be pulled easily by a farm tractor (or even by a lawn tractor or ride mower for snowfall up to about four inches, and higher levels of snow if the mower deck is removed for clearance).

DETAILED DESCRIPTION OF THE INVENTION

Figure 1:
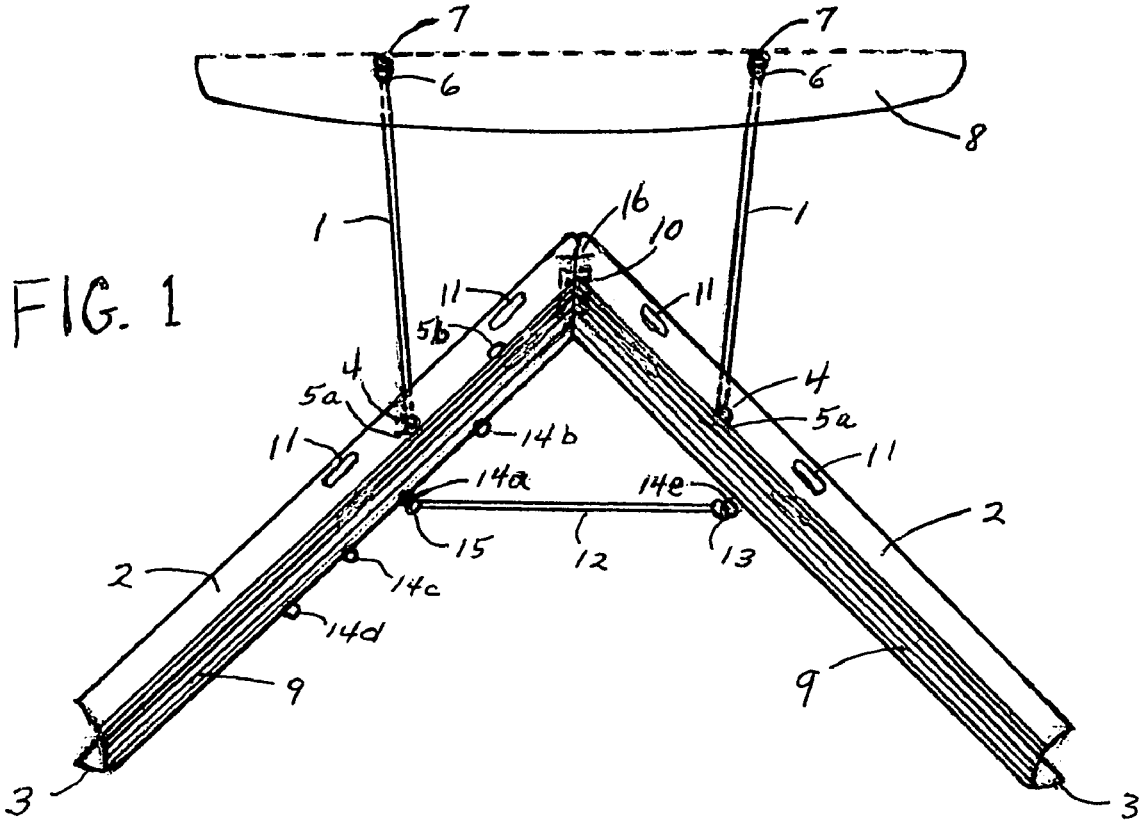
FIG. 1 is a top view of the snowplow set to deposit snow on both sides of the path being plowed.

The present invention is a snowplow whose blades are made of lightweight material such as, but not limited to, plastic (PVC, vinyl, acrylic, etc.), fiberglass, composite material (such as carbon fiber reinforced plastic, which is one of thousands of available kinds of composites), aluminum, or other lightweight metal. Under ordinary use, these blades will leave little snow after plowing, and will be very durable. When the term "such as" is used, hereinafter, it will mean "such as, but not limited to," since it will mean that the means referred to is only an example; it is used to facilitate understanding of the description, but it is not to be taken as limiting. However, for even cleaner snow removal, optional strips of tough, but flexible, material (not illustrated in the drawings) may be attached to the blades' contact edge, which meets the surface being plowed. In very-frequent-use situations, optional metal or other hard, inflexible strips may be attached to the lower, or contact, edge of the plow's blades to extend blade life.

The plow consists of two blade units that can be connected to each other and attached to a towing vehicle in less than one minute. It can be detached and disassembled in like time.

FIG. 1 is a top view of the plow showing two rigid members, hereinafter called "struts" 1, which are attached to the concave faces 2 of the plow blades 3 by a means of attachment 4 on the strut and a means of connection 5*a* on the blade. (The struts normally remain attached to the plow blades, but are removable for the purpose of repositioning the plow to redirect the deposit of snow, as will be explained below under FIG. 4.) The other ends, or loose ends, of the struts 1 are attached by means of attachment 6 on the struts fastened to means, or points, of connection 7, such as small drilled holes in or small eye-bolts on the towing vehicle's bumper or bumper cover 8 (hereinafter for simplicity called "bumper"), or other convenient locations on the vehicle.

In this embodiment, these struts 1 are of equal length, set at equivalent points on the two blades 3, in order to deposit snow equally on both sides of the path being plowed. The struts are rigid in order to stabilize the plow, not allowing it to sway to one side or the other when subjected to differential resistance on the two faces 2 of the plow blades 3—unlike earlier versions of plows attached to a towing vehicle at one point (such as a trailer hitch) or connected to the towing vehicle by a flexible and/or collapsible means (such as a chain or rope).

The front faces 2 of the plow blades 3 are concave (and the rear faces 9 are, of course, convex). The blades are tilted backward so that the tops of the blades are farther from the towing vehicle than the bottoms of the blades; this causes the snow to press down on its way to disposal, thereby helping to keep the plow hugging the surface of the path being plowed, and avoids the necessity to use heavy materials.

A connection means, such as a lift-off (and thus "drop-in") quick-connect hinge 10, which is a plate on one blade with a hollow tube attached to the outer side facing the edge of the plate, and a plate on the other blade with a pin attached to the outer side of that plate, whereby the pin fits into the hollow tube of the first plate, affording a quick and easy method of assembling and disassembling the snowplow with only two hands. Thus this hinge connects the front ends of the two blades, which are flattened and trimmed to receive the hinges. A retaining pin 16 is passed through holes in the snowplow blades 3, just above the hinge 10, which prevents one plate of the hinge from rising above or lifting off the other plate of the hinge as a result of uneven vertical pressures during operation. Convenient handhold means 11 are provided in or on the blades to ease lifting, carrying, and manipulating the blades and indeed the entire snowplow.

A transverse element 12 "inside" the plow is attached to one blade (in this illustration the right blade) by a means of attachment 13 hooked to a means, or point, of connection on the blade 14*e*. It is attached for plowing to the other blade by another means of attachment 15 on the loose end of the transverse element, hooked to a means, or point, of connection 14*a* on the other blade. The transverse element 12 serves two functions: it helps to stabilize the plow, and it is a bar used to set the plow blades to the width of the path desired. In one embodiment the transverse element is a fixed-length crossbar 12 hooked by a means of attachment 13 to just one means, or point, of connection 14*e* on one blade (again, the right blade) and to the other blade at one of several means, or points, of connection 14*a*, 14*b*, 14*c*, or 14*d* affixed along the length of the left blade; the closer to the front point of the plow, the wider the plowed path would be. By design, this method requires only one length of transverse element and only one reattachment to change the width of the plow, unlike methods used in the past with a plurality of crossbars of various lengths, and requiring more than one reattachment. In another embodiment the transverse element is a telescoping bar composed of two submembers, one sliding within the other, which has aligning holes at suitable intervals to receive a spring-activated stub, which automatically locks the two submembers into any one of several fixed lengths.

Figure 2:
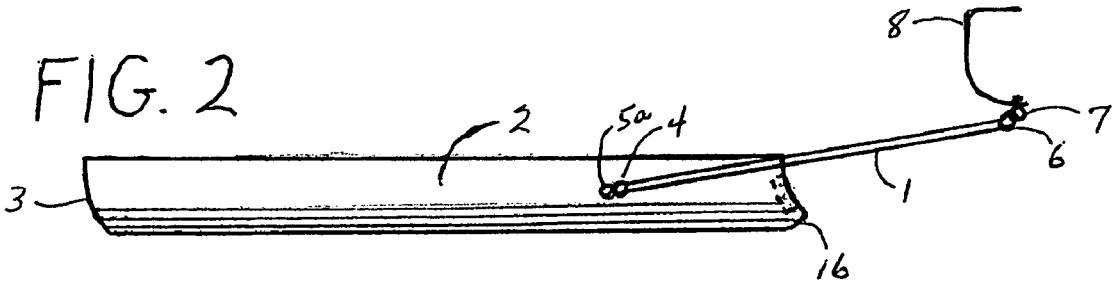
FIG. 2 is a side view of the snowplow.

FIG. 2 is a side view of the plow showing one of the two struts, 1, which is attached to the face 2 of the plow's right-side blade 3 by a means of attachment 4 on the strut and a means of connection 5*a* on the blade. The other end, or loose end, of the strut 1 is attached by a means of attachment 6 on the strut fastened to a means, or point, of connection 7, such as a small drilled hole or a small eye-bolt at the underside edge of the vehicle's bumper 8, or other convenient location on the vehicle.

The forward ends of the blades 3 (constituting the front point of the plow) are beveled at the bottom 16, the purpose of which, along with other elements, is to help the plow rise over any small obstruction that may be in its path.

Figure 3:
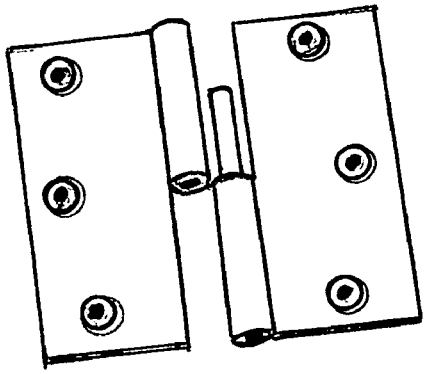
FIG. 3 illustrates a lift-off (and thus "drop-in") quick-connect hinge, which is just one of several possible means of connecting the two blade units to form the front end of the plow.

FIG. 3 illustrates the lift-off (and thus "drop-in") quick-connect hinge 10, which is described above in paragraph 0037, and which is just one of several possible means of connecting the two blade units 3 to form the front end of the plow.

Figure 4:
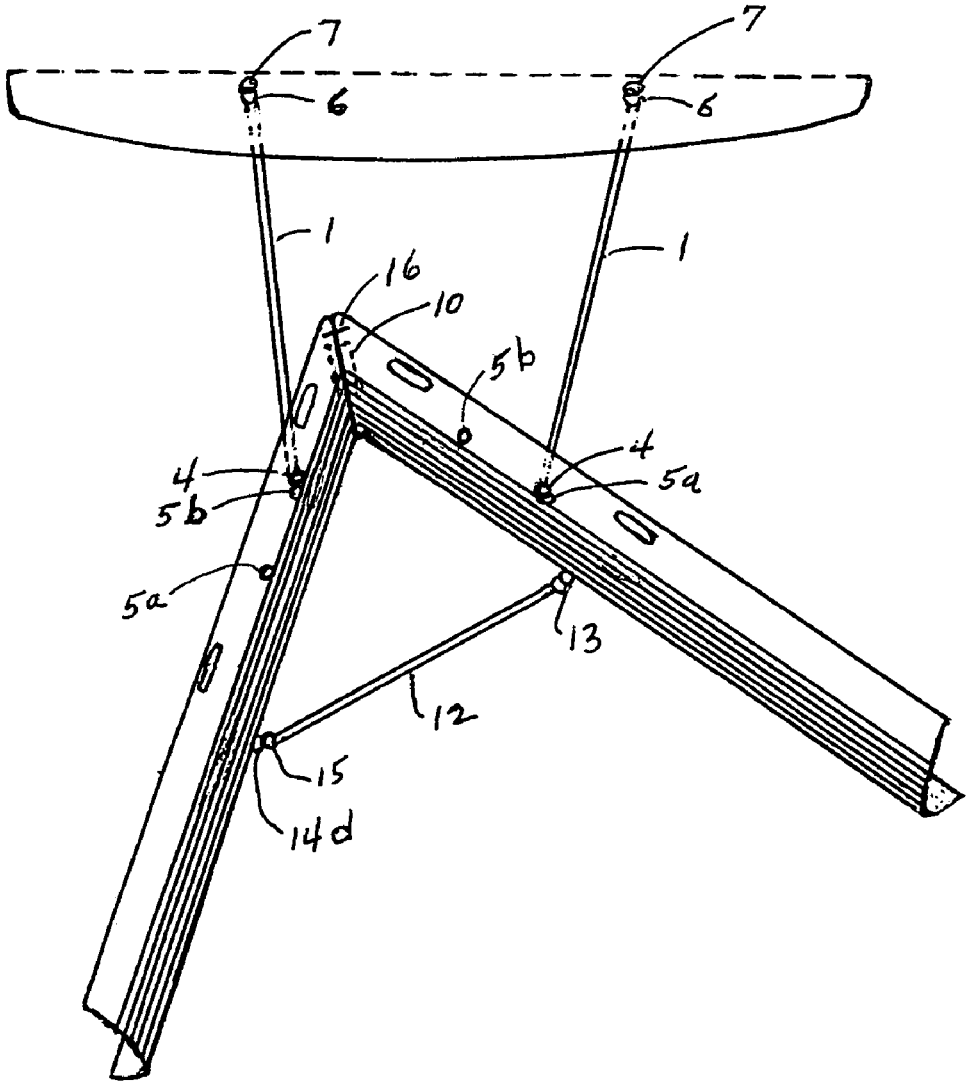
FIG. 4 shows a top view of the snowplow set to deposit snow primarily on the right side (facing forward) of the path being plowed. (A corresponding arrangement, not here illustrated, deposits snow on the left side.)

FIG. 4 is a top view of the plow with the plow set at a narrow width and the left strut, 1 attached to a means of connection 5*b* near the front of the left blade 3, in order to orient the plow for deposit of the bulk of the snow on the right side of the path being plowed. (Repositioning the right strut, instead of the left strut, would cause the bulk of the snow to be deposited on the left side of the path, of course.) In another embodiment, instead of repositioning one of the fixed struts, the same effect is accomplished by the use of optional, but more expensive, telescoping struts to reorient the plow by extending the length of one of the struts. (The telescoping strut used in this invention is a device composed of two submembers, one sliding within the other, which has aligning holes at suitable intervals to receive a spring-activated stub, which automatically locks the two submembers into any one of several fixed lengths.)

In operation, the user assembles the plow in a matter of seconds, as follows: The user connects the leading ends of the right and left blades to each other to form a vee at the vertex by attaching one part of the quick-connect hinge installed on one blade 3 to its corresponding part on the other blade 3, and a retaining pin is passed through the blades, as described above in paragraph 0037. The user then attaches the loose end of the transverse element 12 to one of several means, or points, of connection 14*a,* 14*b,* 14*c,* or 14*d* on the left blade, as described above in paragraph 0038. Then, in a matter of a few more seconds, the user attaches the loose ends of the struts 1 to the means, or points, of connection on the towing vehicle's bumper 8 or other convenient location, as described above under FIG. 1, paragraph 0034. When not in use, these bumper means of connection do not leave unsightly hardware equipment on the vehicle to impair its attractiveness, as in the prior art in many instances.

After assembling the two units of the plow and connecting it to the towing vehicle, the vehicle slowly advances over the path to be cleared. A one-hundred-foot-long driveway, for example, is cleared of virtually all snow in about fifteen seconds; a fifty-foot-long driveway in half that time. It's that quick and easy. Sometimes, depending on the kind of snowfall, a small amount of surface snow (no more than the amount left by conventional plowing equipment), and the narrow tracks of the tires are all that may remain in the path plowed. Any such residue is usually eliminated soon by melting, evaporation, or sublimation between storms, but in any event, no difficulty remains for the passage of vehicles over the plowed path.

In the case of multiple plowings, such as when snow drifts, or when a blizzard of, say, fifteen or twenty inches of snow is predicted, or in an area of frequent snow storms, the user may wish to plow a wide path the first time, say nine feet wide in a driveway. For a second pass, after another accumulation of snow, an eight-foot path could be plowed within the first nine-foot path. A third or fourth pass, if necessary, can be made by simply narrowing the width of the plow. Since automobiles and station wagons in general need only a five-foot track width (pick-up trucks and some sport utility vehicles slightly more), this example gives ample opportunity to keep a drive path clear of snow for passing through. In most areas, normal sunshine and warm periods of the day will serve to eliminate or lessen the accumulation of snow between storms.

In some circumstances it may be more desirable to deposit the bulk of the snow to one side of the path. This can be accomplished by orienting the plow as described above under FIG. 4, paragraph 0042. The path plowed will be narrower in this case, but still wide enough. A second pass for greater width can be made, if desired.

Because of the plow's light weight, the angle at which the blades move forward, the front point 16 (in FIG. 2) of the plow beveled in relation to the surface, and the small amount of "play" in the connections, the plow will not cause damage to surfaces plowed or to curbing, and it will easily rise over any small bumps or minor obstructions in its path, such as the reflectors imbedded in many roads in fog-prone areas—without damage to the objects or the plow. (Such reflectors, in this example, are often damaged or dislodged by conventional plows, requiring labor to install displaced, new, or repaired reflectors.)

To aid in the dispersal of snow, the blades of the plow may be coated with a lubricant such as silicone spray, but this is not really necessary.

Upon completion of plowing, the user disconnects the plow from the vehicle and separates one unit of the plow from the other (in less than one minute), nests one unit of the plow into the other, and stores it horizontally or vertically in a relatively small space.

What is claimed is:

1. A v-shaped snowplow attached to a towing vehicle for removing snow or slush from driveways, roadways, parking lots, and walkways, comprising:

a. a first and second blade each having a concave front side facing the towing vehicle and an opposite convex back side, each blade having a front end that is flat, a font edge that is beveled backwards from a bottom of the blade and a top that is tilted backwards from the towing vehicle;

c. a first plate on the flat front end of the first blade with a hollow tube attached to an outer edge of the first plate, a second plate on the flat front end of the second blade with a pin attached to an outer edge of the second plate, wherein the pin fits into the hollow tube of the first plate and attaches the flat front ends of the blades together;

d. a transverse retaining pin passing through a hole in each blade above the first and second plate, whereby the plates are prevented from disengaging each other;

e. the first blade having a plurality of means of connection spaced intermittently along the convex back side, the second blade having a single means of connection on the convex back side;

f. a transverse element with means of attachment on first and second ends, the means of attachment on the first end of the transverse element connected to any one of the means of connection on the convex back side of the first blade, the means of attachment on the second end of the transverse element connected to the means of connection on the convex back side of the second blade, wherein the v-shaped width of the plow is adjusted by connecting the transverse element to a different one of the means of connection on the convex back side of the first blade;

g. each blade having a plurality of means of connection spaced intermittently along the concave front side;

h. a first and second strut, each with means of attachment on first and second ends;

i. a first and second means of connection on a rear bumper of the towing vehicle, the means of attachment on the first end of the first strut attached to the first means of connection on the rear of the towing vehicle, the means of attachment on the first end of the second strut attached to the second means of connection on the rear of the towing vehicle; and j. the means of attachment on the second end of the first strut connected to any one of the means of connection on the concave front side of the first blade, the means of attachment on the second end of the second strut connected to any one of the means of connection on the concave front side of the second blade, whereby the plow is oriented differently with respect to the towing vehicle by connecting the struts to a different one of the means of connection on the concave front side of the blades.

2. The snowplow of claim 1 wherein the blades are made from polyvinyl chloride.

3. The snowplow of claim 1 wherein each blade has a handhold.

4. The snowplow of claim 1 wherein the blades further include strips of tough flexible material on the bottom.

5. The snowplow of claim 1 wherein the struts are of fixed length.

6. The snowplow of claim 1 wherein the struts are composed to a first submember and a second submember, the first submember sliding within the second submember, the second submember having a plurality of holes which align to receive a spring activated stub on the first submember whereby the first and second submembers are locked together.

* * * * *